US009414175B2

(12) United States Patent
Doller

(10) Patent No.: US 9,414,175 B2
(45) Date of Patent: Aug. 9, 2016

(54) MICROPHONE TEST PROCEDURE

(71) Applicant: Robert Bosch GmbH, Stuttgart (DE)

(72) Inventor: Andrew J. Doller, Sharpsburg, PA (US)

(73) Assignee: Robert Bosch GmbH, Stuttgart (DE)

( * ) Notice: Subject to any disclaimer, the term of this patent is extended or adjusted under 35 U.S.C. 154(b) by 109 days.

(21) Appl. No.: 14/258,465

(22) Filed: Apr. 22, 2014

(65) Prior Publication Data

US 2015/0010157 A1 Jan. 8, 2015

Related U.S. Application Data

(60) Provisional application No. 61/842,694, filed on Jul. 3, 2013.

(51) Int. Cl.

| | |
|---|---|
| ***H04R 29/00*** | (2006.01) |
| ***H04R 3/00*** | (2006.01) |
| ***H04R 19/04*** | (2006.01) |

(Continued)

(52) U.S. Cl.

CPC ..... *H04R 29/004* (2013.01); *H04R 3/005* (2013.01); *H04R 19/005* (2013.01); *H04R 29/006* (2013.01); *H04R 1/04* (2013.01); *H04R 2201/003* (2013.01)

(58) Field of Classification Search

CPC ..... H04R 17/02; H04R 2201/003; H04R 19/016; H04R 19/04; H04R 1/38; H04R 1/406; H04R 1/245; H04R 2410/00; H04R 2430/20; H04R 29/004; H04R 3/007; B81B 7/008

USPC ..... 381/58, 111–115, 122

See application file for complete search history.

(56) References Cited

U.S. PATENT DOCUMENTS

| | | | |
|---|---|---|---|
| 5,029,215 | A | 7/1991 | Miller, II |
| 8,036,401 | B2 | 10/2011 | Poulsen et al. |

(Continued)

FOREIGN PATENT DOCUMENTS

| | | |
|---|---|---|
| EP | 1906704 | 4/2008 |
| WO | 2014023363 | 2/2014 |

OTHER PUBLICATIONS

International Search Report and Written Opinion for Application No. PCT/US2014/044509 dated Mar. 11, 2014 (11 pages).

(Continued)

*Primary Examiner* — Duc Nguyen
*Assistant Examiner* — George Monikang
(74) *Attorney, Agent, or Firm* — Michael Best & Friedrich LLP

(57) ABSTRACT

In one embodiment, the invention is a microphone system with an internal test circuit. The system includes a microphone having a housing with an acoustic port, a first transducer, a second transducer, a controller, and a current source. The system also includes an acoustic assembly with a cover and an acoustic pressure source positioned in the cover. When the acoustic assembly is positioned over the acoustic port, an acoustic chamber is formed, and a signal can be applied to the acoustic pressure source such that a first set of measurements can be taken. The acoustic assembly can be removed and replaced with an acoustic cover to take a second set of measurements. Based on the first and second measurements, sensitivities of the first and second transducers can be determined. In another embodiment, the invention provides a method for calibrating the sensitivity of a microphone.

19 Claims, 15 Drawing Sheets

(51) Int. Cl.

| | |
|---|---|
| ***H04R 9/08*** | (2006.01) |
| ***H04R 19/00*** | (2006.01) |
| *H04R 1/04* | (2006.01) |

(56) References Cited

U.S. PATENT DOCUMENTS

| | | | |
|---|---|---|---|
| 8,170,238 | B2 | 5/2012 | Wu |
| 2011/0142261 | A1 | 6/2011 | Josefsson |
| 2011/0313763 | A1 | 12/2011 | Amada |
| 2013/0039500 | A1 | 2/2013 | Sridharan et al. |
| 2013/0044898 | A1 | 2/2013 | Schultz et al. |
| 2013/0136267 | A1 | 5/2013 | Hammerschmidt et al. |

OTHER PUBLICATIONS

Wagner et al., "New Measurement Service for Determining Pressure Sensitivity of Type LS2aP Microphones by the Reciprocity Method," Journal of Research of the National Institute of Standards and Technology, vol. 116, No. 5, Sep.-Oct. 2011, pp. 761-769.

MICROPHONE TEST PROCEDURE

RELATED APPLICATION

The present application claims the benefit of prior filed U.S. Provisional Patent Application No. 61/842,694, filed on Jul. 3, 2013, the entire content of which is hereby incorporated by reference. The present application is also related to co-file U.S. Patent Application No. PCT/US2014/044509.

BACKGROUND

The present invention relates to a microphone test procedure, specifically to a microphone test procedure for calibrating the sensitivity of a microphone.

In order to take detailed measurements with a microphone, its precise sensitivity must be known. Since this may change over the lifetime of the device, it is necessary to regularly calibrate measurement microphones. A microphone's sensitivity varies with frequency (as well as with other factors such as environmental conditions) and is therefore normally recorded as several sensitivity values, each for a specific frequency band. A microphone's sensitivity can also depend on the nature of the sound field it is exposed to. For this reason, microphones are often calibrated in more than one sound field, for example a pressure field and a free field.

Microphone calibration services are offered by some microphone manufacturers and by independent certified testing labs. The calibration techniques carried out at designated microphone calibration sites often involve multiple additional microphones in order to calibrate a single device. All microphone calibration is ultimately traceable to primary standards at a National Measurement Institute, such as NIST in the U.S. The reciprocity calibration technique is the recognized international standard with regard to microphone calibration and testing procedures.

SUMMARY

In one embodiment, the invention is a microphone with two or more reciprocal membranes that provide transduced pressure measurements to an internal test circuit. The internal test circuit outputs an absolute measurement of sensitivity. This absolute sensitivity refers to the sensitivity of the microphone transducers, and can be determined at manufacture based on first principle measurements (e.g., current, voltage, ambient air conditions, volume of the acoustic volume of the microphone), which are easily obtained by direct measurement or by other means. In one embodiment, the invention also provides a method for determining the absolute transducer sensitivity from first-principle measurements.

The final output sensitivity of the microphone signal refers to the sensitivity of the microphone output signal, which can be controlled by either applying a calculated electronic gain to the input signal (generated by the transducers upon receiving acoustic pressure waves from an acoustic source) or by modulating a bias voltage applied to a MEMS transducer. The final output sensitivity of the microphone signal can be controlled based on user-defined adjustment parameters.

In one embodiment, the invention is a microphone system with an internal test circuit. The system includes a microphone having a housing with an acoustic port, a first transducer, a second transducer, a controller, and a current source. The system also includes an acoustic pressure source assembly with a cover and an acoustic pressure source positioned in the cover. When the acoustic pressure source assembly is positioned over the acoustic port, an acoustic chamber is formed, and a signal can be applied to the acoustic pressure source such that a first set of measurements can be taken. The acoustic pressure source assembly can also be removed and replaced with an acoustic cover such that a second set of measurements can be taken. Based on the first and the second measurements, a sensitivity of the first transducer and a sensitivity of the second transducer can be determined.

In another embodiment, the invention provides a method for calibrating the sensitivity of a microphone. The method includes generating an acoustic pressure in an acoustic chamber of the microphone, where the acoustic chamber is formed by covering an acoustic port of the microphone with an acoustic pressure assembly. The method also includes measuring, by a controller, a voltage output by a first transducer of the microphone and a first voltage output by a second transducer of the microphone. The method also includes removing the acoustic pressure assembly from the acoustic port and covering the acoustic port. A current to the first transducer is then applied, and the controller measures a second voltage output by the second transducer, and calculates a sensitivity of the first and second transducers based on the measurements.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
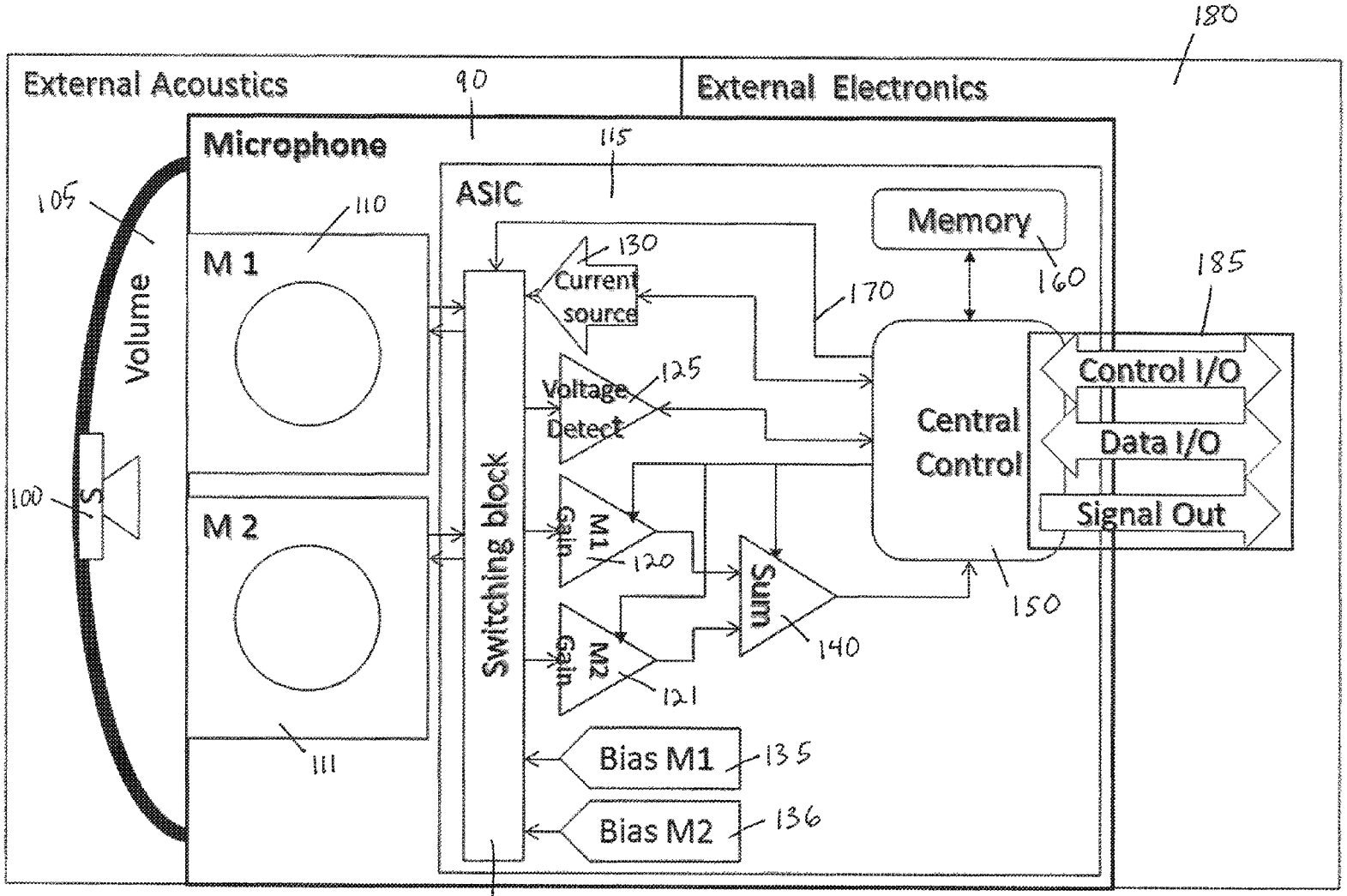
FIG. 1 is a schematic of a microphone that uses electronic gain to control an output signal.

FIG. 1 is a microphone 90 that adjusts the output sensitivity of a microphone signal by controlling an electronic gain applied to the input signal (i.e., the signal generated by the transducers in response to receiving acoustic pressure waves from an acoustic pressure source). The microphone includes a speaker 100 placed within an acoustic volume 105 that is filled with a fluid such as air. The microphone also includes a first pressure-sensitive membrane 110 and a second pressure-sensitive membrane 111, and includes an application-specific integrated circuit (ASIC) 115. The membranes 110 and 111 are connected to the ASIC 115 through a switching block 116 included in the ASIC 115. The switching block 116 is connected to a first amplifier 120 and a second amplifier 121, a voltage detector 125, a current source 130, and a first and second bias circuit 135 and 136 by which bias voltages are applied to the membranes 110 and 111. The amplifiers 120 and 121 are further connected to a summing amplifier 140, which in turn connects to a controller 150. The controller 150 is also connected to a memory 160 (e.g., a non-transitory computer readable media).

The controller 150 can comprise a processor for executing code from the memory 160. The controller 150 also sends commands and/or data to the components included in the ASIC via a communication bus 170, except to the bias supply means 135 and 136. Also, the controller 150 sends commands and communicates with the external electronics via an input/output interface 185. The controller 150 also receives input from the components in the ASIC via the communication bus 170, and receives input from the external electronics 180 via the input/output interface 185. The input/output interface 185 can include a user interface such as a Liquid Crystal Display (LCD) screen or software Graphical User Interface (GUI), for example. The controller 150 can communicate parameters with a user through the input/output interface 185, and a user can input parameters to the controller 150 through the input/output interface 185.

The final output sensitivity of a microphone refers to the final sensitivity of the microphone's output signal, which can be adjusted by the internal microphone electronics. For example, in FIG. 1, the controller 150 modulates the gains of the amplifiers 120 and 121 to modify the output sensitivity of the microphone 90. When the first and second membranes 110 and 111 receive acoustic pressure inputs from the speaker 100 (propagating through the acoustic volume 105), a first and second electrical signal is generated by the membranes 110 and 111, respectively, in response. The signals generated by the membranes 110 and 111 are received by the switching block 116 based on the characteristics (such as frequency) of the pressure input, and switching block 116 outputs the signals to the first and second amplifiers 120 and 121. The first amplifier 120 applies a gain to the first transducer's 110 generated signal, and the second amplifier 121 applies a gain to the second transducer's 111 generated signal. The modified signals are then summed at the summing amplifier 140 and sent to the controller 150. The controller 150 then outputs the summed modified acoustic signal (which now exhibits the adjusted output sensitivity) via the input/output interface 185. Alternatively or additionally, the controller 150 stores the signal to the memory 160 (e.g., to be recalled for future microphone operations).

The gains applied to each signal by the amplifiers 120 and 121 are calculated by the controller 150 based on information received via the input/output interface 185. This adjustment information received via the input/output interface 185 can either be user-specified or determined otherwise by the external electronics 180. The adjustment information can include a user-specified voltage, and can be stored to the memory 160 for future communication with the user or the external electronics 180 (such as at a subsequent power on, for example). Similarly, the absolute sensitivity of the membranes 110 and 111 (as determined at manufacture), as well as the final output sensitivity of the microphone 90 (generated based on the adjustment input information), can also be stored to the memory 160 for future communication or processing.

Figure 2:
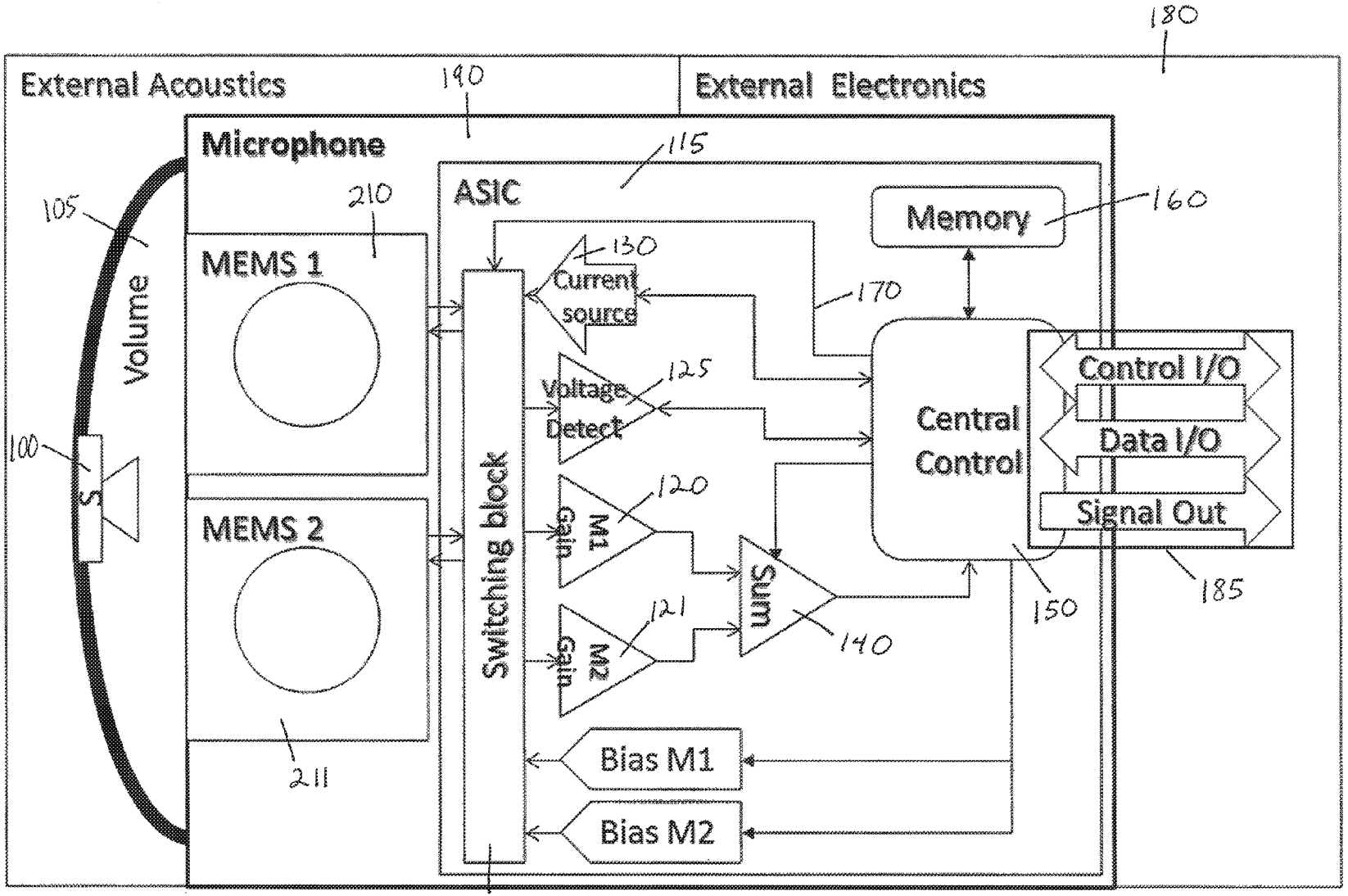
FIG. 2 is a schematic of a microphone that uses a controllable MEMS bias to control an output signal.

FIG. 2 illustrates a microphone 190 that controls the final output sensitivity by varying MEMS biasing. It should be noted that the microphone 190 of FIG. 2 includes many of the same components as those described in FIG. 1. Therefore, these components are numbered according to the reference numerals of FIG. 1. This is done for ease of description of the exemplary embodiments only, and is not intended to imply that like components must be implemented in other embodiments of the invention. In FIG. 2, a first and second MEMS transducers 210 and 211 receive acoustic pressure waves from the speaker 100, as opposed to the pressure-sensitive membranes 110 and 111 of FIG. 1. In the case of FIG. 2, the signals generated by the MEMS transducers 210 and 211 are modified by adjusting the bias voltage applied to the MEMS transducers 210 and 211 by bias elements 135 and 136 through the switching block 116. Particularly, the controller 150 calculates the amount of bias voltage to apply to the MEMS transducers 210 and 211. By modulating the amount of bias voltage applied to the MEMS transducers 210 and 211, a transduction coefficient of the MEMS transducers 210 and 211 can be changed. Changing the transduction coefficient adjusts the transducer sensitivity and thus the sensitivity of the output signal. The calculated bias voltages are applied at the switching block 116 such that the bias voltage from bias element 135 is applied to the MEMS transducer 210, and the bias voltage from bias element 136 is applied to the MEMS transducer 211.

The switching block 116 then outputs the modified signals to the amplifiers 120 and 121, and the summing amplifier 140 further sums the signals. Note that in the case of FIG. 2, the amplifiers 120 and 121 are not controlled by the controller 150. However, the controller 150 still controls the summing amplifier 140. After the modified signals are summed at the summing amplifier 140, the summed modified signal is received by the controller 150 to be output via the input/output interface 185 or to be stored to the memory 160. As explained above with regard to FIG. 1, the controller 150 determines the amount of bias for each signal based on the specified adjustment information (i.e., data) received via the input/output interface 185. As with the microphone 90 in FIG. 1, the absolute sensitivity of the MEMS transducers, as well as the final output sensitivity of the acoustic signal can be stored to the memory 160 for future recall.

Figure 3:
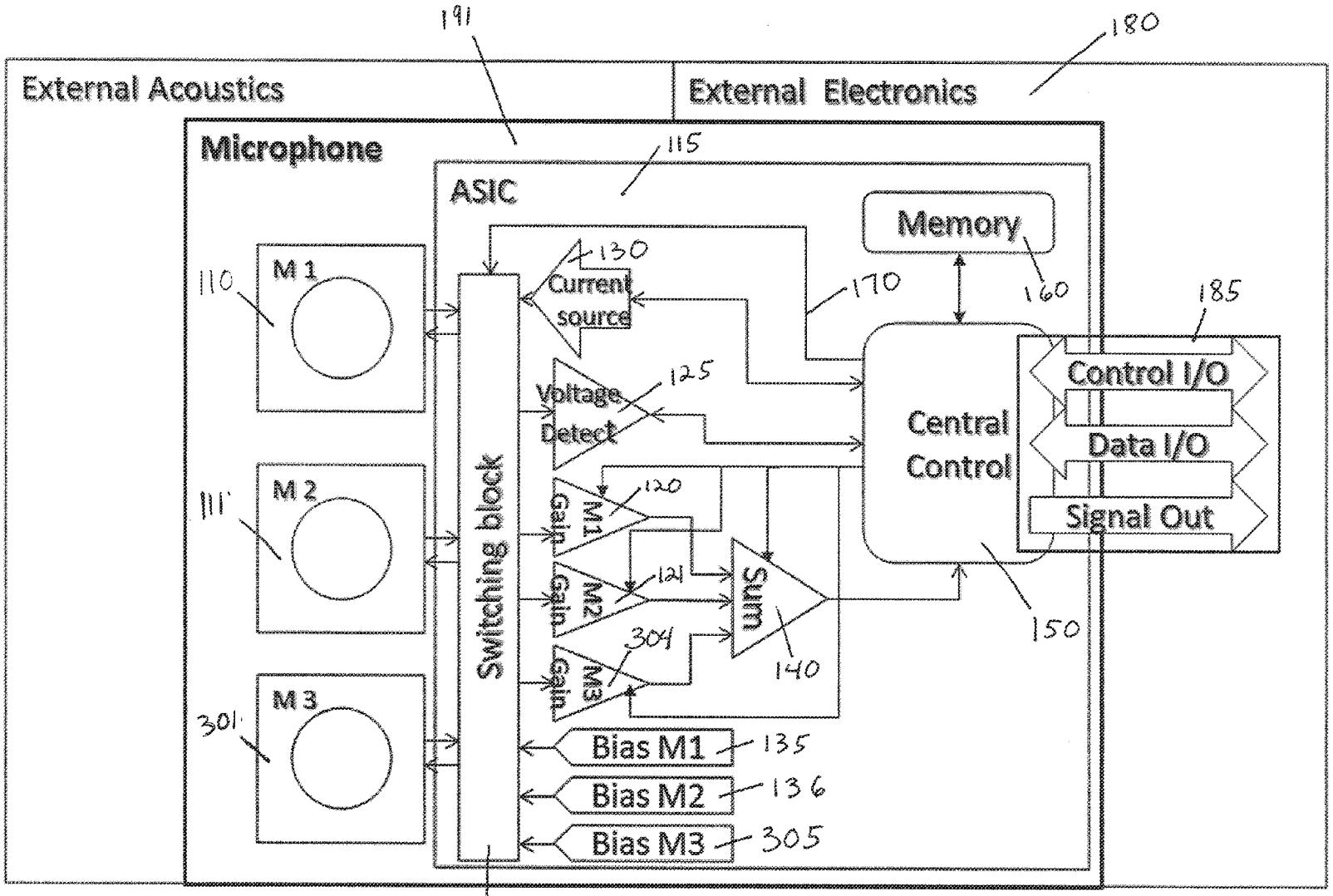
FIG. 3 is a schematic of another microphone embodiment that uses electronic gain to control an output signal.

FIG. 3 illustrates a microphone similar to that of FIG. 1. However, the microphone of FIG. 5 includes a third pressure-sensitive membrane 301. The microphone of FIG. 3 also includes a third amplifier 304 that receives signals generated by the third membrane 301. As with the amplifiers 120 and 121, the third amplifier 304 is controlled by the controller 150 via the bus 170. Thus, the controller 150 can modify the gain of the third amplifier 304, which modifies the output sensitivity of the third membrane 301. The output of the third amplifier 304 is also summed at the summer 140 with the outputs from the amplifiers 120 and 121. Further, a third bias element 305 provides a bias voltage to the membrane 301.

Figure 4:
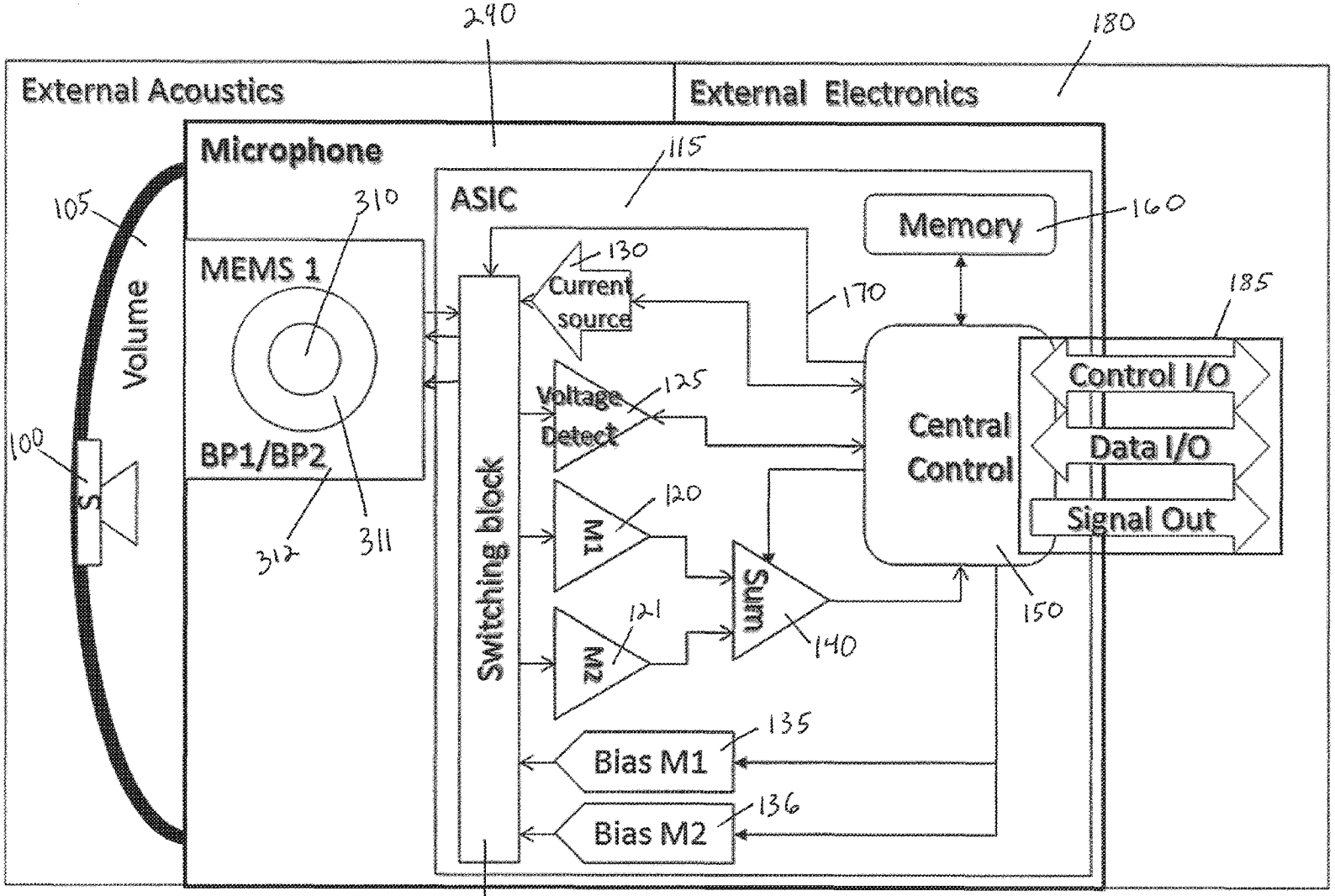
FIG. 4 is a schematic of a microphone that uses a controllable MEMS bias and a three-electrode MEMS device to control an output signal.

FIG. 4 shows a microphone similar to that of FIG. 2. The microphone of FIG. 4, however, uses split electrodes 310 and 311 contained on a single die of MEMS transducer 312, rather than the two electrodes on two separate dies of FIG. 2. The backplates ("BP1/BP2") of the MEMS transducer 312 are electrically isolated from one another to accommodate for the split arrangement of electrodes 310 and 311. Thus, there are a total of three electrodes for a single MEMS transducer in the microphone of FIG. 4, versus the four electrodes across two separate MEMS transducers required for the microphone of FIG. 2. Again, the microphone of FIG. 4 controls output sensitivity by varying the MEMS biasing as explained above with regard to FIG. 2. Particularly, the signal generated by the split electrodes 310 and 311 are modified by adjusting the bias voltages.

Figure 5:
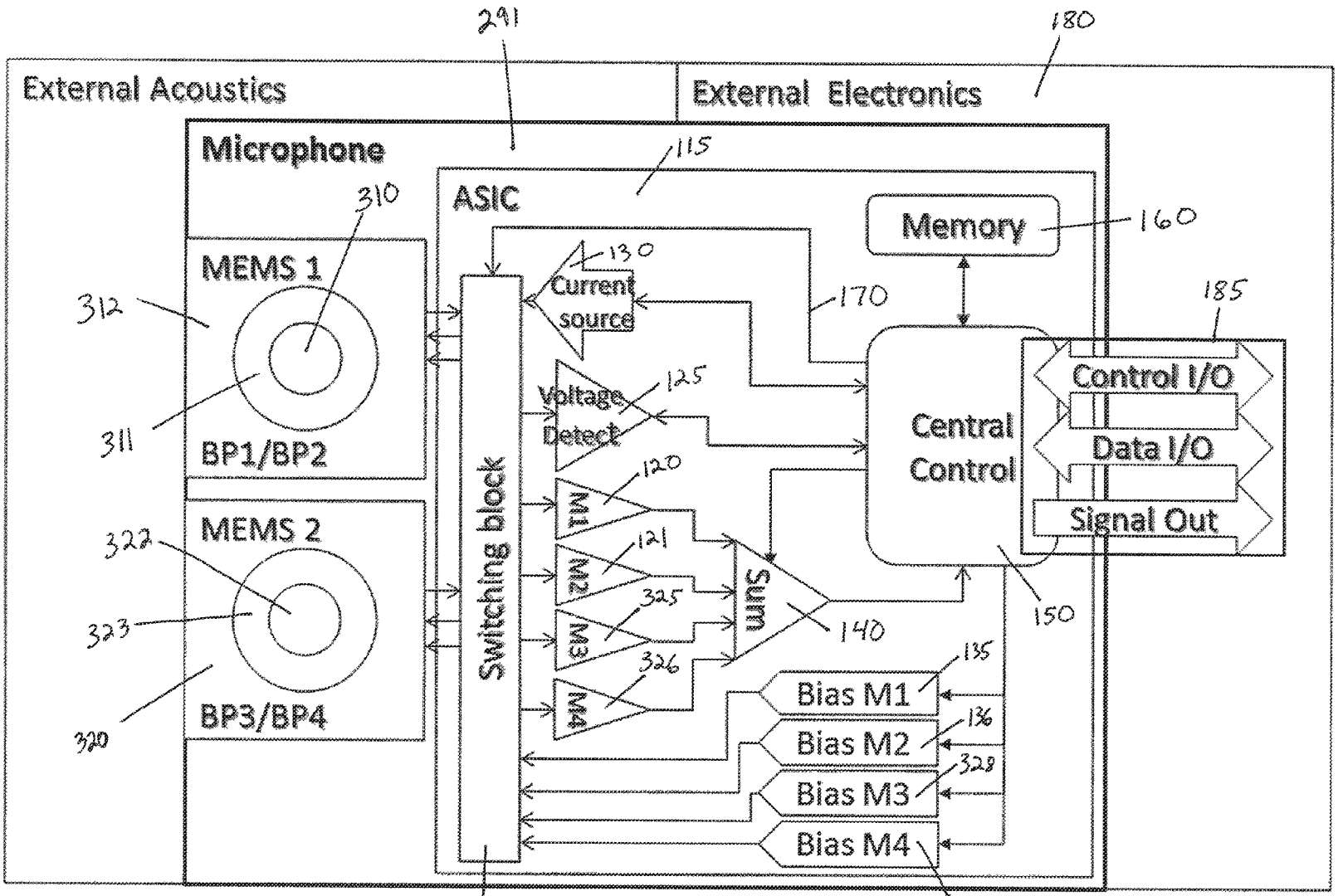
FIG. 5 is a schematic of a microphone embodiment that uses a controllable MEMS bias and two three-electrode MEMS devices to control an output signal.

FIG. 5 illustrates a similar MEMS microphone to that of FIG. 4. However, the microphone of FIG. 5 includes a second split MEMS transducer 320 ("MEMS 2"), which replaces the speaker 100 and the acoustic volume 105 in a similar way as does the membrane 301 of FIG. 3. That is, the second split MEMS transducer 320 has split electrodes 322 and 323 (contained on the same die), which can generate acoustic pressure waves in the microphone packaging (i.e., an internal microphone volume). The acoustic pressure waves generated by the split electrodes 322 and 323 can be received by the first split MEMS transducer 312. Likewise, the first split MEMS transducer 312 can generate acoustic pressure waves to be received by the second split MEMS transducer 320. Thus, the first and second split MEMS transducers 312 and 320 can be calibrated in absence of the acoustic volume 105 and speaker 100. In particular, the first and second split MEMS transducers 312 and 320 can be calibrated according to the calibration procedures described in further detail below.

As with the electrodes 310 and 311 of the first split MEMS transducer 312, the signals generated by each of the electrodes 322 and 323 are sent to the switching block 116 and received by amplifiers 325 and 326. The signals are then sent to the summer 140. Further, the signals can be modified by adjusting the bias voltages applied to the electrodes 322 and 323. In particular, the controller 150 controls bias elements 328 and 329 to modify the bias voltages.

The absolute transducer sensitivity (such as for a pressure-sensitive membrane or MEMS transducer) refers to a characteristic of the transducer which cannot be readily altered by signal processing, alone. Reciprocity calibration can be used for calibrating the absolute transducer sensitivity of microphones. The technique exploits the reciprocal nature of certain transduction mechanisms. The reciprocity theorem states that if a voltage is supplied to a linear passive network at its first terminal, and produces a current at another terminal, the same voltage applied to a second terminal will generate the same amount of current as at the first terminal. Measurement microphones are usually capacitor microphones, and, thus, exhibit reciprocity behavior. For the embodiments of FIGS. 1, 2, and 4, reciprocity calibration is carried out using an acoustic coupler. The acoustic coupler outputs a pressure pulse into the test microphone and elicits the microphone's response. Provoking the microphone's response allows the microphone's sensitivity to be measured and thus calibrated. For the embodiment of FIG. 3, the function of the acoustic coupler is replaced by the third membrane 301. For the embodiment of FIG. 5, the function of the acoustic coupler is replaced by the second split MEMS transducer 320. However, it should be noted that the functions of the third membrane 301 and of the second split MEMS transducer 320 are not limited to those of an acoustic coupler, as described above. The membrane 301 and the MEMS transducer 320 can be used for other functions, as well, such as for transducing acoustic pressure waves.

Figure 6:
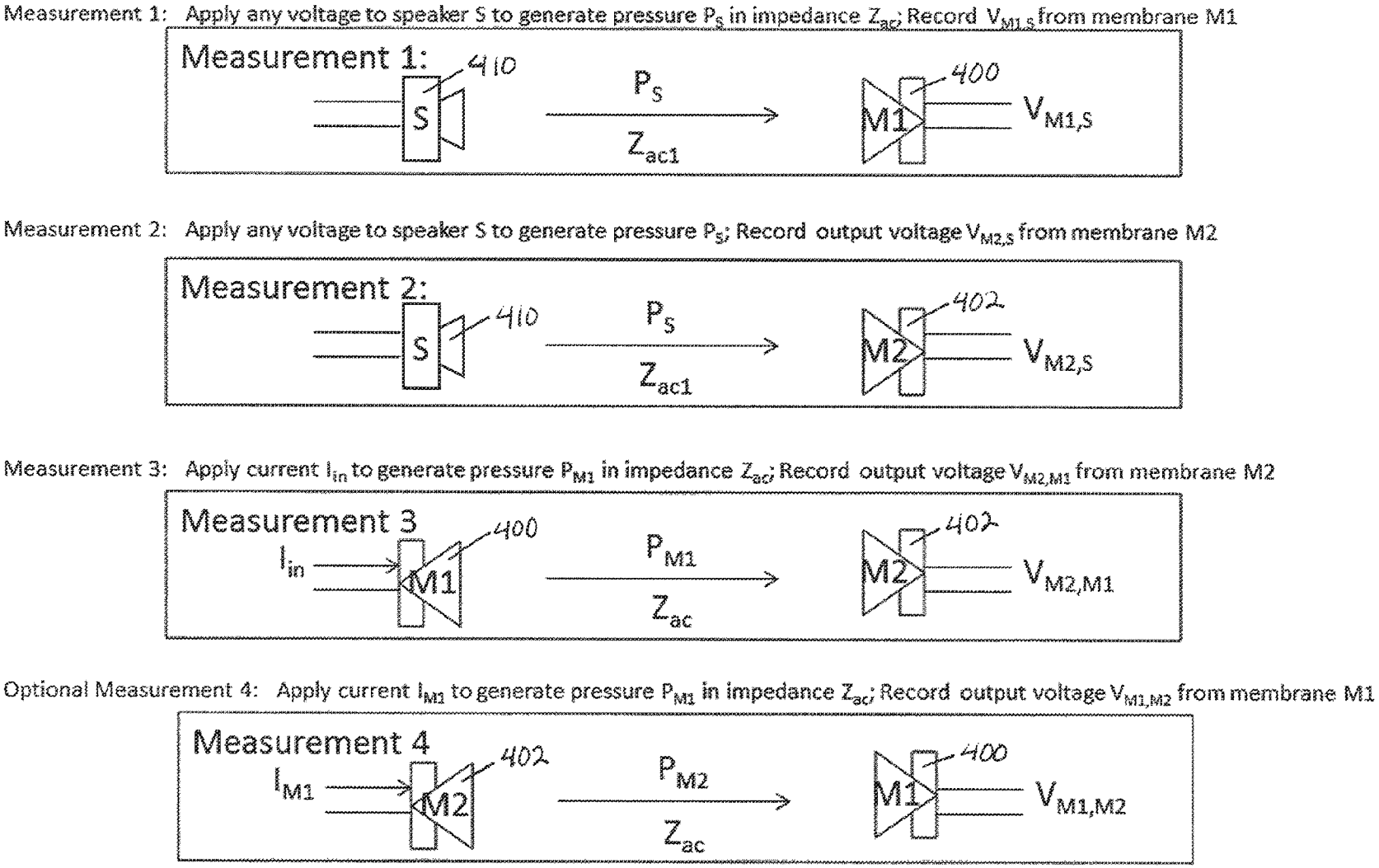
FIG. 6 illustrates the measurements taken to calibrate a microphone.

The ensuing discussion is directed toward a microphone test procedure for determining the absolute sensitivity of one or more microphone transducers, as well as for calibrating the transducers. FIG. 6 shows an adaptation of the reciprocity technique for calibrating a microphone and the measurements taken to determine the absolute sensitivity of the microphone transducers. Specifically, four measurements are taken by the system. The microphone components involved in the calibration measurements are a first transducer 400 and a second transducer 402, as well as a speaker 410. However, note that the speaker 410 is not required to be an acoustic coupler like the speaker 100 and acoustic volume 105 of FIGS. 1, 2, and 4, but can also be an additional membrane or transducer such as the membrane 301 of FIG. 3 and the MEMS transducer 320 of FIG. 5. The transducers 400 and 402 can include any combination of the membranes 110, 111, and 301, the MEMS transducers 210 and 211, and/or the split-electrode MEMS transducers 312 and 320.

Figure 7A:
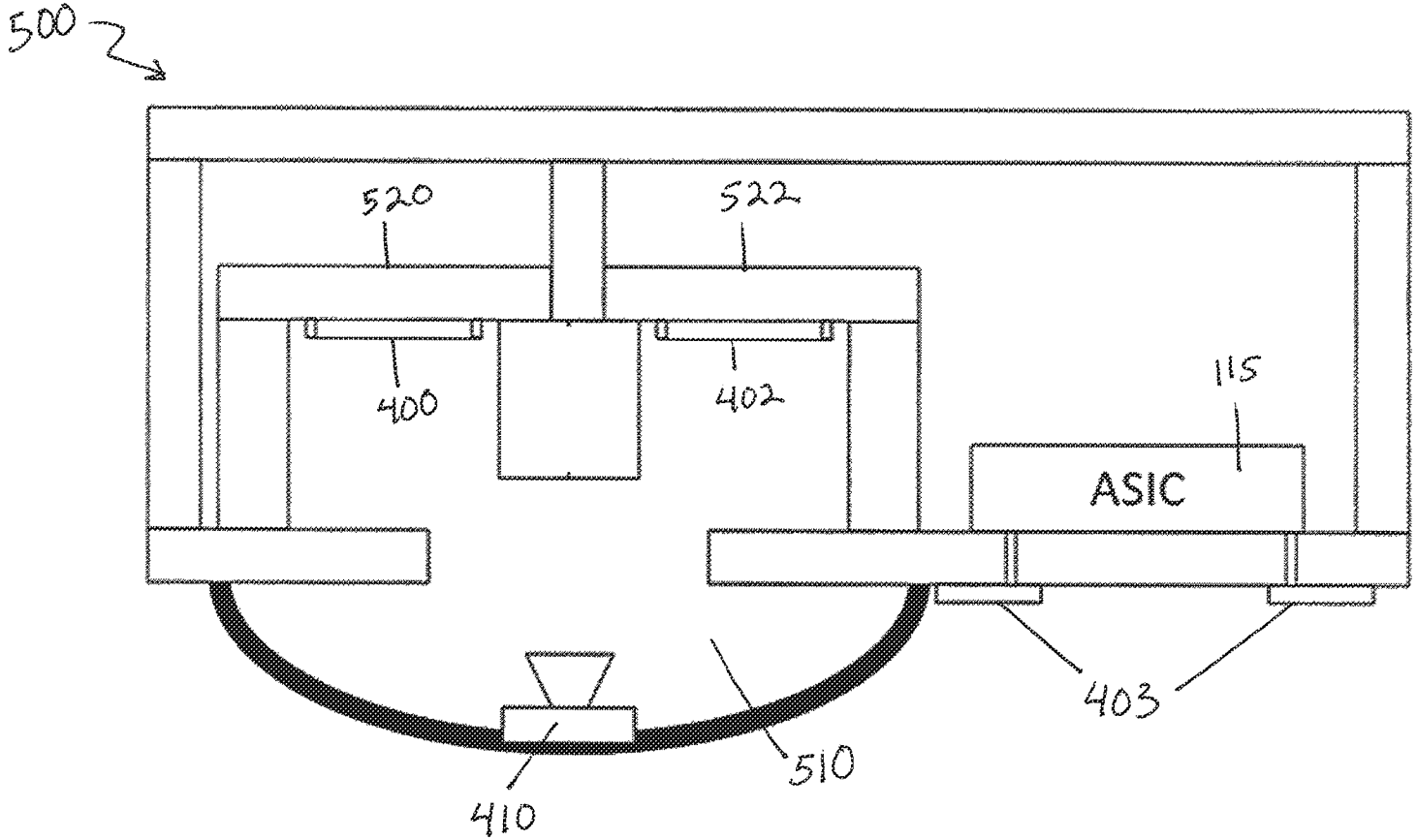
FIG. 7A is a test setup for performing measurements 1 and 2 in FIG. 6.
Figure 7B:
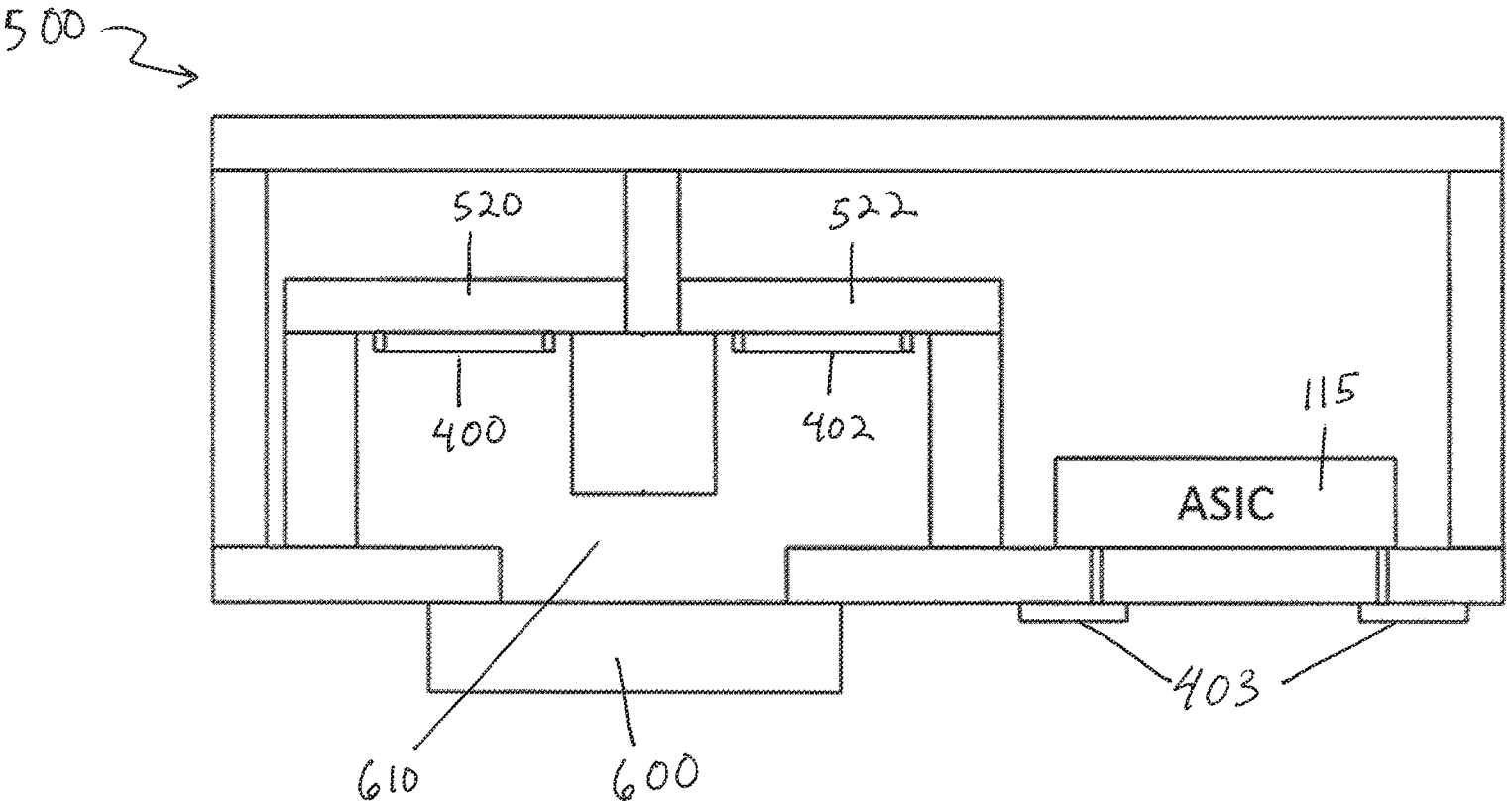
FIG. 7B is a test setup for performing measurements 3 and 4 in FIG. 6.

FIG. 7A illustrates a test setup 500 for measurements 1 and 2. The test setup includes the transducers 400 and 402, an ASIC 115, ASIC input/output ports 403, and an acoustic volume 510 with an impedance $Z_{ac1}$ (as shown in FIG. 6). The test setup 500 also includes a backplate 520 for the transducer 400, as well as a backplate 522 for the transducer 402. The movement of the membranes of transducers 400 and 402, with respect to the backplates 520 and 522, causes a change of capacitance in the transducers 400 and 402. This capacitance change generates signals (e.g., voltages) from the transducers 400 and 402 dependent on the nature of the impinging acoustic pressure waves. FIG. 8B illustrates the test setup 500 while performing measurements 3 and 4 of FIG. 6 for the embodiments of FIGS. 1, 2, and 4 (i.e., the embodiments including the speaker 100 and the acoustic volume 105). The changes in FIG. 8B include a sealing gasket 600 that replaces the speaker 410 so as to isolate the transducers 400 and 402 for measurements 3 and 4. The sealing gasket 600 forms a new acoustic volume 610, which has an impedance $Z_{ac}$ (as shown in FIG. 6). For the embodiments of FIGS. 3 and 5, the sealing gasket 600 is not necessary, since the membranes and transducers of FIGS. 3 and 5, respectively, already share the volume of the microphone packaging, as will be described below in further detail.

Referring to FIG. 6, first and second pressure measurements are taken by applying a voltage to the speaker 410 (Measurement 1 and Measurement 2). In Measurements 1 and 2, a voltage applied to the speaker 410 generates a pressure $P_s$ in the acoustic volume 510 with an impedance $Z_{ac1}$. The transducers 400 and 402 each transduce the pressure Ps and output a corresponding voltage signal ($V_{M1,S}$ and $V_{M2,S}$). The voltage signal output by the transducers 400 and 402 is then processed by the ASIC 115. Processing by the ASIC 115 can include, for example, modifying the signals using the methods described above with regard to modulating the amplifier 120 and 121 gains, or modulating a bias voltage applied to the MEMS transducers 210 and 211. Processing by the ASIC 115 can also include storing the signals to the memory 160. For the third measurement (Measurement 3), the speaker 410 with acoustic volume 510 is replaced with a sealing gasket 600, which forms the new acoustic volume 610 having an impedance $Z_{ac}$. The sealing gasket 600 isolates the transducers 400 and 402 to create a controlled environment with few obstructions to the pressure waves generated and received by the transducers 400 and 402. Particularly, in Measurement 3, a current $I_{in}$ is supplied from the current source 130 to the transducer 400. The current $I_{in}$ causes the transducer 400 to generate a pressure $P_{M1}$ in the acoustic volume 610. The pressure $P_{M1}$ is transduced by the transducer 402 and recorded as the output voltage $V_{M2,M1}$ (i.e., the voltage generated by the transducer 402 in response to the pressure waves from the transducer 400). The output voltage $V_{M2,M1}$ is also sent to the ASIC 115 for processing, as described for the voltage signals $V_{M1,S}$ and $V_{M2,S}$.

An optional fourth measurement may be taken by applying a current $I_{M1}$ to the transducer 402. The current $I_{M1}$ is the current generated by the voltage $V_{M2,M1}$ from Measurement 3. When the current $I_{M1}$ is applied to the transducer 402, the transducer 402 generates the pressure $P_{M2}$ in the acoustic volume 610. The pressure $P_{M2}$ is then received by transducer 400 which then generates a voltage $V_{M1,M2}$ (i.e., the voltage generated by the transducer 400 in response to the pressure waves from the transducer 402).

The output voltages ($V_{M1,S}$, $V_{M2,S}$, $V_{M1,M2}$, and $V_{M2,M1}$) recorded by performing Measurements 1-4 are used to calculate the absolute sensitivity of the transducers 400 and 402. Thus, when the output voltages are processed by the ASIC 115, the processing also includes calculating the absolute transducer sensitivities, which is carried out by the controller 150 based on the measured values of the output voltages and first-principle measurements. The transducer sensitivity ($M_{o,M1}$ and $M_{o,M2}$) is the ratio of the elicited voltage in the transducer by the speaker (i.e., $V_{M1,S}$ or $V_{M2,S}$) to the acoustic pressure originally generated by the speaker (i.e., $P_s$). This concept is represented by equations 1 and 2, below. From this concept of the transducer sensitivity, the absolute sensitivity for a particular microphone's transducers ($M_{o,M1}$ and $M_{o,M2}$) can be derived and evaluated with the measured voltages ($V_{M1,S}$, $V_{M2,S}$, $V_{M1,M2}$, and $V_{M2,M1}$) and first-principle values, which are either well-known or easily measured.

Particularly, the absolute sensitivities of the transducers 400 and 402 can be derived according to the following mathematical procedure:

from Measurements 1 and 2, $$V_{M2,S}=M_{o,M2}\cdot P_S,\ V_{M1,S}=M_{o,M1}\cdot P_S \tag{1, 2}$$

$$V_{M2,S}/V_{M1,S}=M_{o,M2}/M_{o,M1} \tag{3}$$

$$M_{o,M2}=M_{o,M1}\cdot(V_{M2,S}/V_{M1,S}) \tag{4}$$

and, from Measurement 3 and equation 4, $$M_{o,M2}\cdot M_{o,M1}=(1/Z_{ac})\cdot(V_{M2,M1}/I_{in}) \tag{5}$$

$$(M_{o,M1})^2\cdot(V_{M2,S}/V_{M1,S})=(1/Z_{ac})\cdot(V_{M2,M1}/I_{in}) \tag{6}$$

From Measurement 4 (or, by substituting equation 6 into equation 3), $$M_{o,M1}\cdot M_{o,M2}=(1/Z_{ac})\cdot(V_{M1,M2}/I_{in}) \tag{7}$$

$$(M_{o,M2})^2\cdot(V_{M1,S}/V_{M2,S})=(1/Z_{ac})\cdot(V_{M1,M2}/I_{in}). \tag{8}$$

Under the assumption that the frequencies of interest (i.e., the frequencies of the pressure waves generated in the acoustic volume 610) are much lower than the requirement for lumped element acoustics to be valid, the acoustic impedance in the volume 610 can be expressed in terms of the following:

$$Z_{ac}=(r\cdot c^2)/(j\cdot V\cdot 2_p f) \tag{9}$$

and the absolute sensitivity of the transducer 400 can then be determined as $$(M_{o,m1})^2=(V_{M1,S}/V_{M2,S})\cdot(1/Z_{ac})\cdot(V_{M2,M1})/(I_{in}), \tag{10}$$

and the absolute sensitivity of the transducer 402 can be determined as $$(M_{o,m2})^2=(V_{M1,S}/V_{M2,S})\cdot(1/Z_{ac})\cdot(V_{M1,M2})/(I_{in}), \tag{11}$$

where:

$V_{M2,S}$=Voltage elicited in membrane (M2) by external speaker (S)

$V_{M1,S}$=Voltage elicited in membrane (M1) by external speaker (S)

$V_{M1,M2}$=Voltage elicited in membrane (M1) by membrane (M2)

$V_{M2,M1}$=Voltage elicited in membrane (M2) by external speaker (M1)

$M_{o,M2}$=Absolute sensitivity of membrane (M2)

$M_{o,M1}$=Absolute sensitivity of membrane (M1)

$P_s$=Pressure generated by external speaker (S)

$Z_{ac}$=Impedance of common acoustic volume $I_{in}$=Input voltage to transmitting speaker (either M1 or M2, depending on which other is receiving)

r=Gas density (e.g., the gas density for air)

c=Speed of sound j=Imaginary operator, sqrt(−1)

$2_p$ f=Radian frequency of sound

V=Cavity volume.

Once calculated by the controller 150, the absolute sensitivities of the transducers 400 and 402 can be communicated to a user via the input/output interface 185, or stored to the memory 160 for recall at a subsequent power on (when the absolute sensitivities can also be communicated via the input/output interface 185). Information regarding the absolute sensitivities of the transducers 400 and 402 is useful when scientific measurements under standardized or otherwise carefully-calibrated conditions must be made, or, for example, when tuning a sound filtering algorithm to optimize signal-to-noise ratio for a specific application of the microphone. It should also be noted that the microphone test procedure of FIG. 6 can also be used to recalibrate or sync the sensitivities of the transducers 400 and 402 with respect to each other periodically, or even after an incident in which the sensitivities of the transducers 400 and 402 may become unexpectedly altered, such as after dropping the microphone. Similarly, for the embodiments of FIGS. 3 and 5, the calibration procedure is performed amongst the membranes and MEMS transducers without an acoustic coupler. For example, referring to FIG. 3, the membrane 301 can be used in place of the speaker 410 to calibrate the membranes 310 and 311 using the same method described above. To calibrate the membrane 301, one of the membranes 310 or 311 can then be used in place of the speaker 410 for the same procedure.

Referring to FIG. 4, since the split electrodes 310 and 311 are mechanically identical and drive a split MEMS transducer, there are no longer two separate MEMS transducers (and thus no longer two separate electrodes to drive each transducer) sharing the acoustic volume 105. Therefore, the reciprocity measurements and calculations described above can be simplified, since, due to the split electrode arrangement (310 and 311), the single, split MEMS transducer can both produce and receive the pressure waves in measurements 3 and 4, as previously described in reference to FIGS. 3 and 5. This reduces the impedance of the acoustic volume 105 to ±1 (where "+1" corresponds to an in-phase capacitance change and "−1" corresponds to an out-of-phase capacitance change, which will be described below in further detail), since the pressure waves produced by the electrodes 310 and 311 do not travel across the acoustic volume 105. Instead, the force of the acoustic pressure waves generated by one electrode can directly influence (i.e. can be received directly by) the other electrode, since the electrodes share the same structure. In particular, this means that a first portion (i.e., electrode) of the split transducer (310) drives the production of acoustic pressure waves, while a second portion of the split transducer (311) receives the pressure waves via a second portion (i.e., electrode) of the split transducer. With $Z_{ac}$ equal to ±1, the volume of the acoustic volume 105 does not need to be known, therefore simplifying the reciprocity calculations described above.

Figure 8:
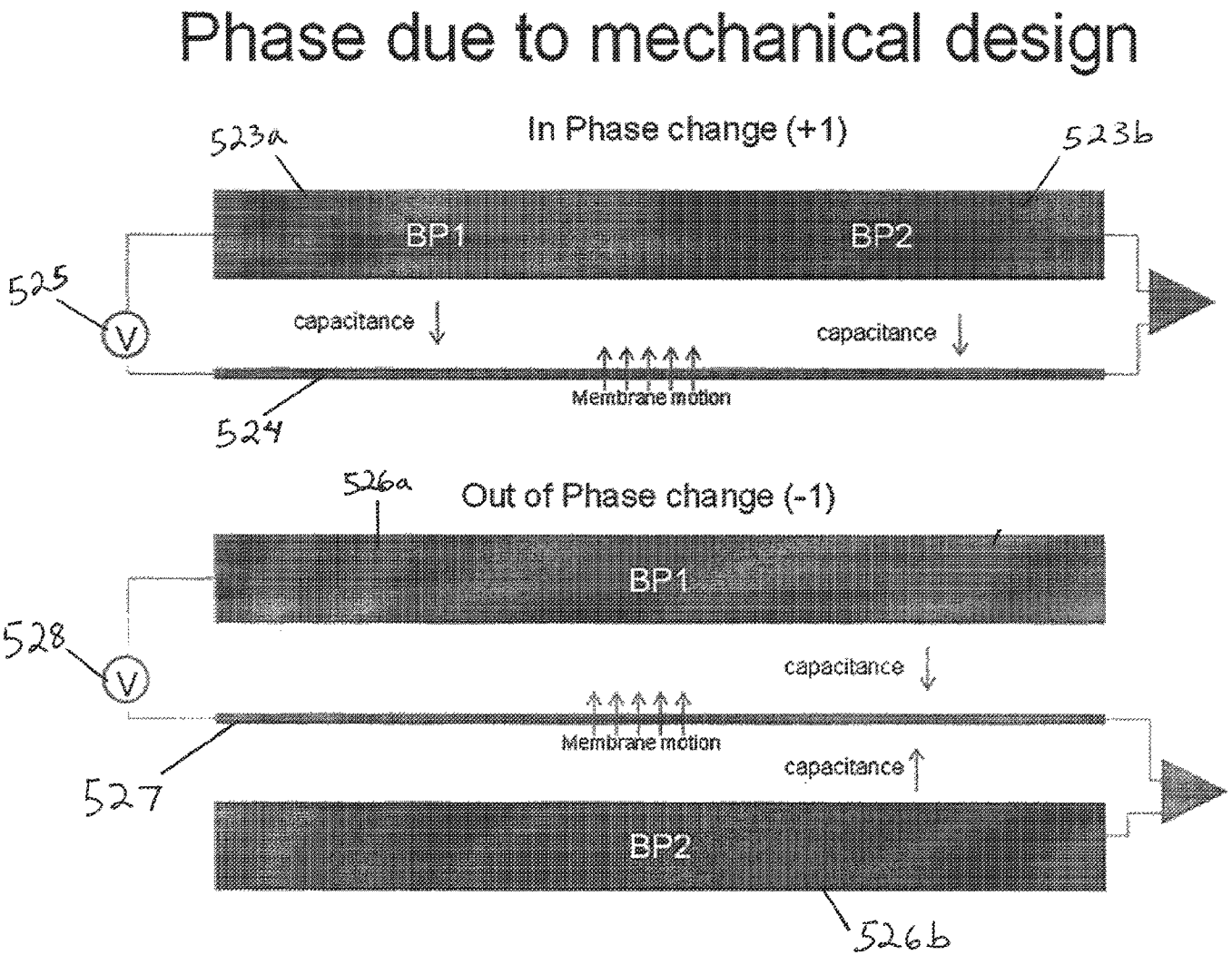
FIG. 8 illustrates two variations of a split electrode MEMS transducer.

FIG. 8 illustrates two mechanical arrangements for an exemplary split MEMS transducer, and how each arrangement affects the change in capacitance sensed by the electrodes. The upper diagram ("In Phase Change (+1)") shows a split MEMS transducer with electrodes 523*a* and 523*b*. The electrodes 523*a* and 523*b* are arranged on the same side of a moveable membrane 524. In this arrangement, if one electrode (e.g., the electrode 523*a*) generates acoustic pressure waves and causes the membrane 524 to displace, the other electrode (e.g., the electrode 523*b*) will sense the change in capacitance, arising from the membrane's 524 displacement, in-phase with the pressure waves generated by the electrode 523*a*. This is due to each electrode being arranged on the same side of the membrane 524, such that the direction of displacement of the membrane 524 is "perceived" as the same by each electrode. However, the lower diagram ("Out of Phase change (−1)") shows a split MEMS transducer with electrodes 526*a* and 526*b*, which are arranged on opposite sides of a membrane 527. In this arrangement, when the membrane 527 displaces, the direction of displacement observed by one electrode will be opposite the direction observed by the other. Thus, the change in capacitance sensed by one electrode (e.g., the electrode 526*b*) will be received out-of-phase with the pressure waves generated by the other (e.g., the electrode 526*a*).

Figure 9A:
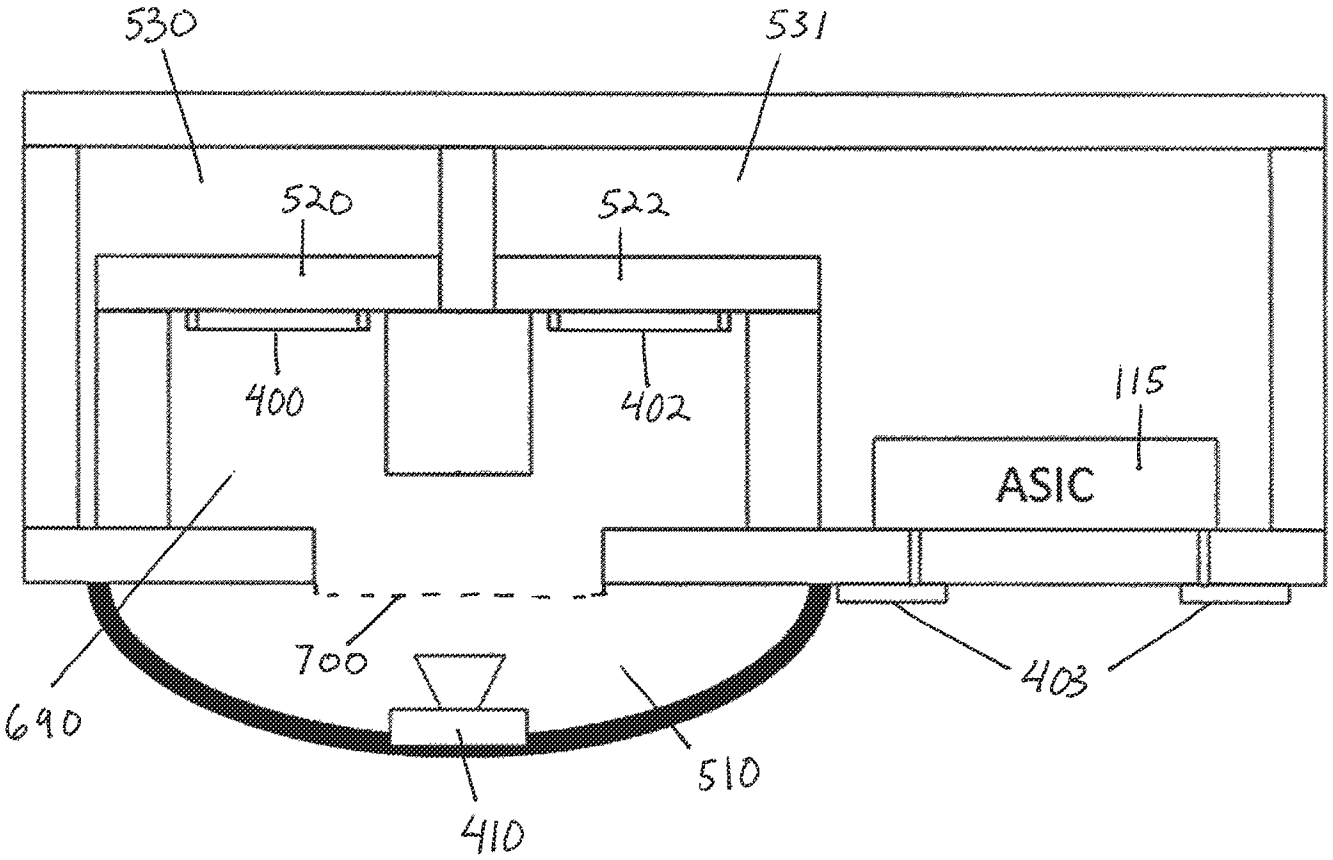
FIGS. 9A-9F illustrate additional exemplary test setups.

FIGS. 9A-9F illustrate alternative arrangements of exemplary test setups for implementing the procedure illustrated in FIG. 6. Each exemplary arrangement includes the speaker 410, the transducers 400 and 402, the ASIC 115, and the ASIC input/output ports 403. FIG. 9A illustrates the same exemplary test arrangement as shown in FIG. 7A. Specifically, FIG. 9A illustrates a test setup in which the speaker 410 and the transducers 400 and 402 share the acoustic volume 510, whereas the larger chamber that houses both the acoustic volume 510 and the ASIC 115 is closed off from the volume 510 and divided into the enclosed chambers 530 and 531. The transducers 400 and 402 are housed in the sub-chambers 690 and 691, such that the transducer 400 is arranged on the interior wall (with respect to the volume 510) of the sub-chamber 690, and the transducer 402 is arranged on the interior wall of the sub-chamber 691. The speaker 410 and the transducers 400 and 402 share the volume 510 by an opening 700, which is a perforation in the microphone allowing acoustic pressure waves from the speaker 410 to propagate into the sub-chambers 690 and 691 to impinge on the transducers 400 and 402.

Figure 9B:
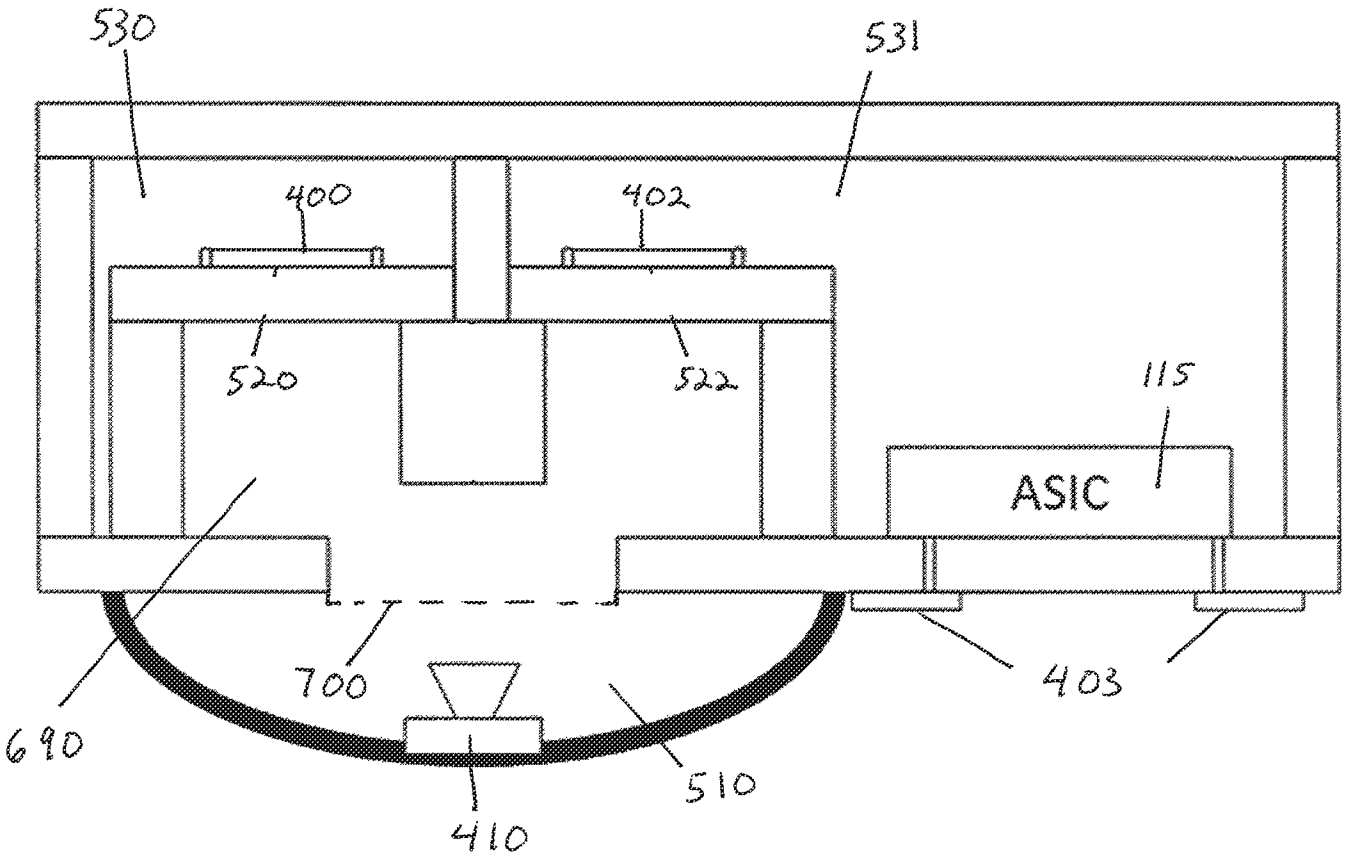
Figure 9C:
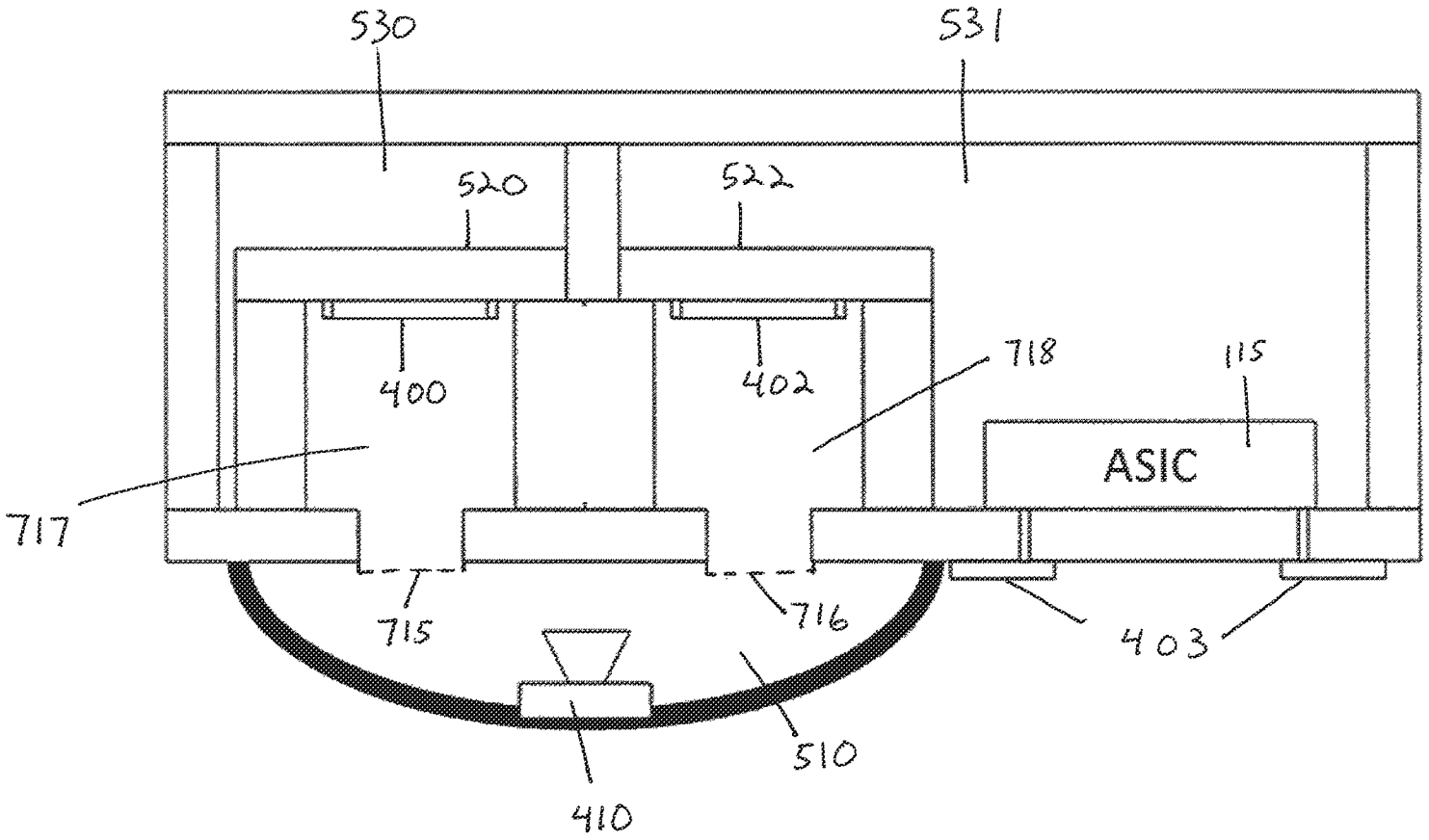

FIG. 9B illustrates a similar test arrangement to FIG. 9A. However, the transducers 400 and 402 in FIG. 9B are affixed to the opposite sides of the backplates 520 and 522 (i.e., the exterior walls of the sub-chambers 690 and 691), such that the transducer 400 is housed within the chamber 530 and the transducer 402 is housed within the chamber 531. In FIG. 9B, the transducers 400 and 402 are closed off from the speaker 410 and the acoustic volume 510. FIG. 9C illustrates another exemplary test setup similar to FIG. 9A. However, instead of having one opening 700 (see FIGS. 9A and 9B) between the speaker 410 and the transducers 400 and 402, the arrangement of FIG. 9C exhibits two openings 715 and 716. The openings 715 and 716 create sub-chambers 717 and 718 that are contiguous with the volume 510, such that the transducer 400 is partially housed by the chamber 717 and the transducer 402 is partially housed by the transducer 718. The two openings 715 and 716 conduct the acoustic pressure waves from the speaker 410 into the chambers 717 and 718, which creates an airflow arrangement in the volume 510 and the chambers 717 and 718 alternative to those found in FIGS. 9A and 9B.

Figure 9D:
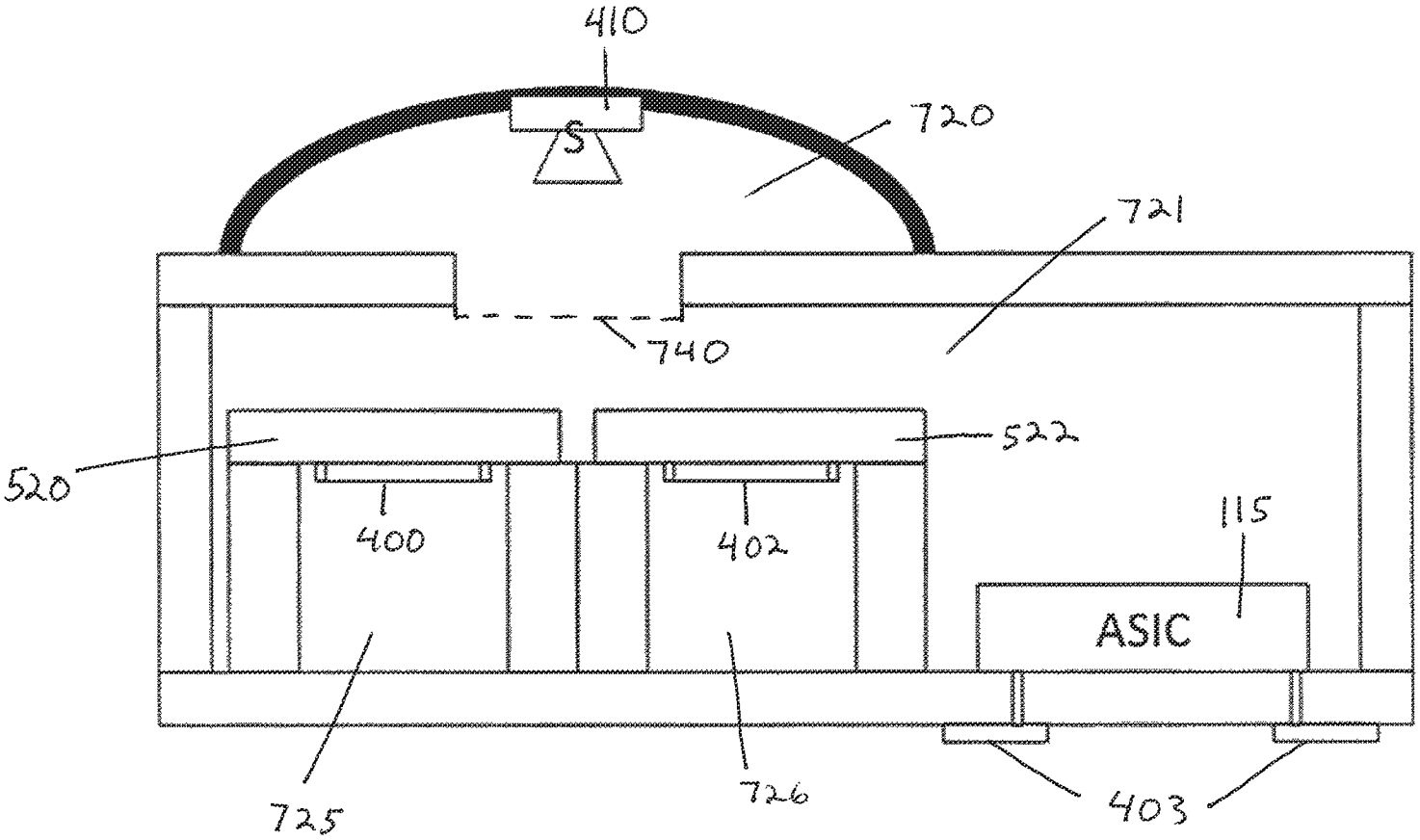
Figure 9E:
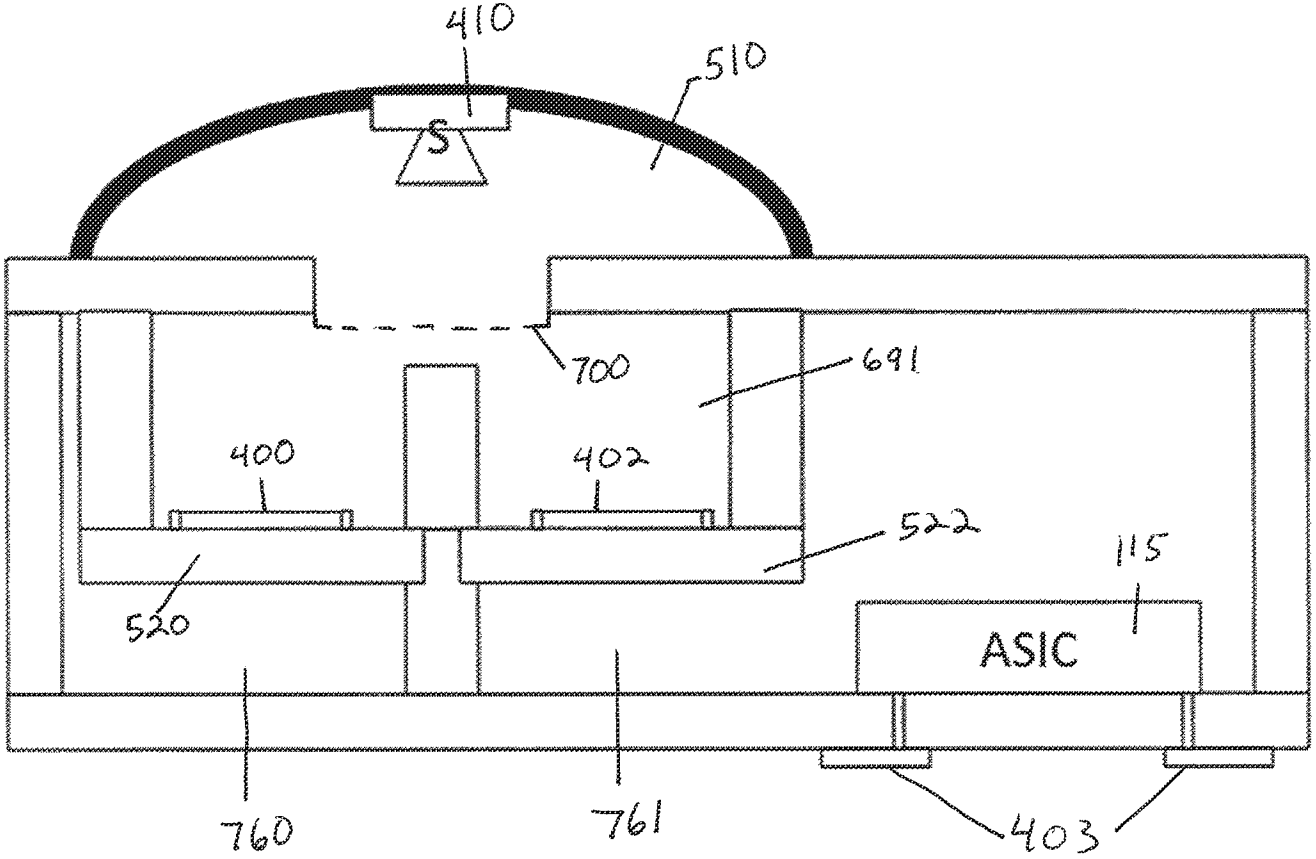
Figure 9F:
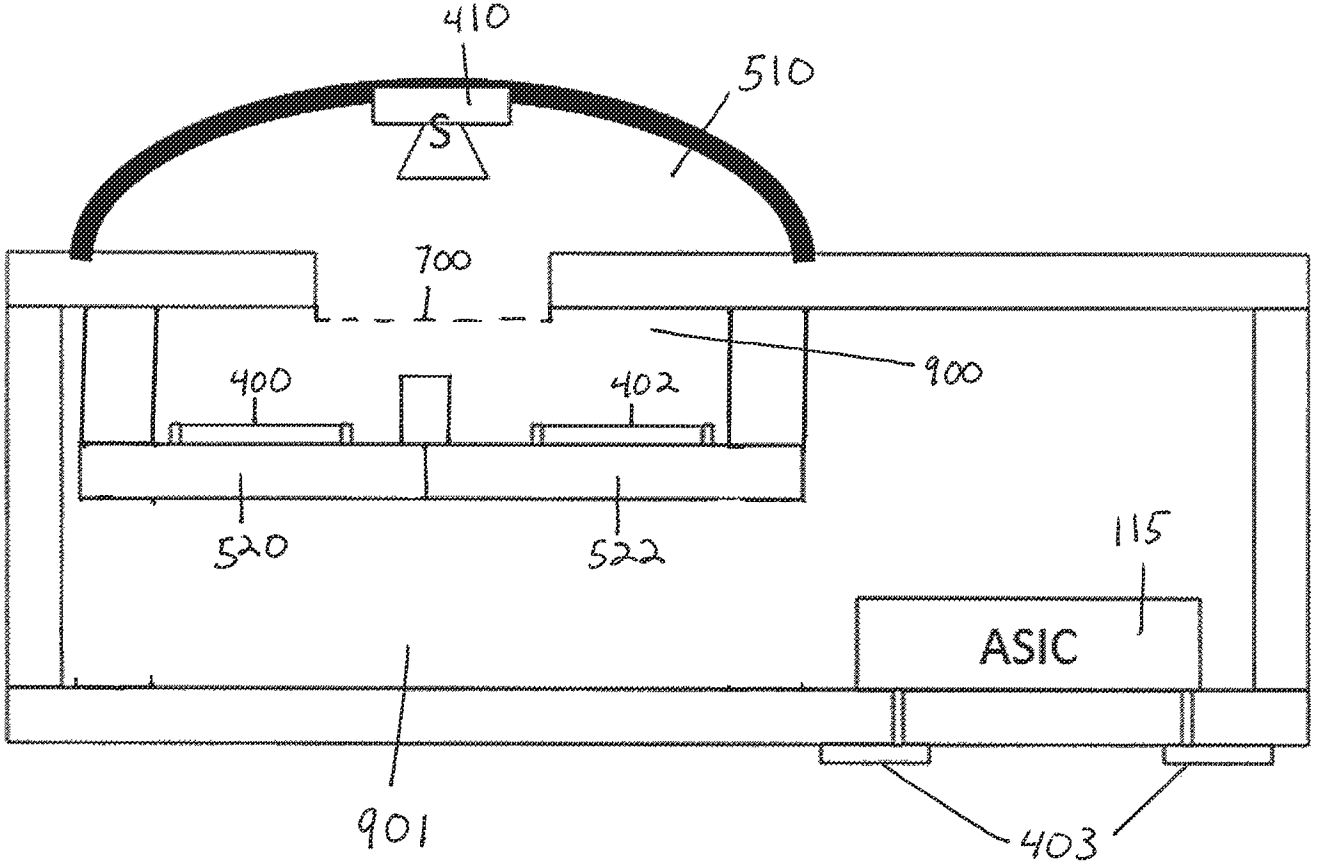

The test arrangement of FIG. 9D shows the speaker 410 positioned on the wall opposite the ASIC 115, such that the speaker 410 and the transducers 400 and 402 no longer share the volume 510. Instead, the speaker 410 is enclosed within the acoustic volume 720, which, unlike the volume 510 from FIGS. 9A-C, shares a space with the larger chamber 721, again creating an alternative airflow arrangement in the test fixture. The transducer 400 is enclosed by the chamber 725, and the transducer 402 is housed by the chamber 726. The speaker 410 and the ASIC 115 now share the volumes 720 and 721 through the opening 740. In FIG. 9E, the speaker 410 is still arranged similarly as in FIG. 9D. However, the speaker 410 is enclosed within the acoustic volume 510, as in FIGS. 9A-C. The arrangement of FIG. 9E is essentially the same as that of FIG. 9A, however, all the components of FIG. 9E (except for the ASIC 115 and the ASIC input/output ports 403) are "flipped" with respect to the arrangement of FIG. 9A. For example, the opening 700 is no longer placed within the wall having the ASIC 115. With this configuration, the sub-chambers 690 and 691 (housing the transducers 400 and 402) open away from the chambers 760 and 761, and toward the speaker 410. Another way in which the test arrangement of FIG. 9E differs from that of FIG. 9A is in the widening of the chambers 690 and 691 in FIG. 9E.

Thus, embodiments of the invention provide, among other things, a microphone system with an internal test circuit for determining and calibrating the absolute sensitivities of transducer membranes in the microphone. The system determines the absolute membrane sensitivity based on first-principle measurements such as current, voltage, the volume of an acoustic resonating chamber, and the ambient air conditions of the testing site. Thus, the system can determine and calibrate absolute membrane sensitivity without the need for carefully calibrated or standardized environments, either at manufacture or after the microphone has already been implemented by an end-user. The system includes a speaker, one or more transducers, an integrated circuit including one or more amplifiers, one or more means for supplying a bias voltage to the transducers, and a controller including a memory and an input/output interface. The controller calculates the absolute membrane sensitivity based on the first-principle measurements, as well as transducer response measurements taken generally by eliciting a voltage response in the transducer by impinging acoustic pressure waves from the speaker on the transducer. Embodiments of the invention therefore also provide, among other things, a microphone test procedure for determining and calibrating the absolute sensitivities of transducer membranes in a microphone.

Various features of the invention are set forth in the following claims.

What is claimed is:

1. A microphone test arrangement, comprising:

a microphone having a housing having an acoustic port, an acoustic pressure source positioned in a cover, such that the acoustic pressure source and the cover comprise an acoustic pressure source assembly, a first transducer, a second transducer, a controller, and a current source;

an acoustic port cover;

wherein the acoustic pressure source assembly is positioned over the acoustic port forming an acoustic chamber and a first signal is applied to the acoustic pressure source and a first set of measurements are taken, the acoustic pressure source assembly is removed and the acoustic port cover is positioned over the acoustic port and a second signal is applied to the one of the first transducer and the second transducer and a second set of measurements are taken; and wherein a first sensitivity of the first transducer and a second sensitivity of the second transducer are determined from the first and second set of measurements.

2. The system of claim 1, wherein the acoustic pressure source comprises a third transducer.

3. The system of claim 2, wherein the acoustic pressure source further comprises a fourth transducer sharing a die with the third transducer, such that a first portion of the die comprises the third transducer and a second portion of the die comprises the fourth transducer.

4. The system of claim 1, wherein the first set of measurements includes measuring a voltage output by the first transducer in response to an acoustic pressure generated by the acoustic pressure source, and measuring a voltage output by the second transducer in response to the acoustic pressure.

5. The system of claim 1, wherein the second set of measurements includes measuring a voltage output by the second transducer when a current is applied to the first transducer.

6. The system of claim 5, wherein the current is applied to the first transducer by the current source.

7. The system of claim 6, wherein the current source is controlled by the controller.

8. The system of claim 1, further comprising a memory, wherein the first and second sensitivities are stored in the memory.

9. The system of claim 1, wherein the sensitivity of the first transducer is defined by the equation $$(M_{o,m1})^2 = \frac{Vm1, S}{Vm2, S} * \frac{1}{Zac} * \frac{Vm2, m1}{Iin}$$

where:

$M_{o,m1}$ = sensitivity of first transducer $V_{m1,S}$ = voltage generated in first transducer by acoustic pressure waves from acoustic source $V_{m2,S}$ = voltage generated in second transducer by acoustic pressure waves from acoustic source $$Z_{ac} = \frac{rc^2}{jv2_p f}$$

$r$ = gas density of a gas in the acoustic chamber $c$ = speed of sound $j$ = imaginary operator $sqrt(-1)$ $2_p f$ = radian frequency of sound $V$ = volume of acoustic chamber $I_{in}$ = current applied to first transducer $V_{m2,m1}$ = voltage generated by the second transducer when $I_{in}$ is applied to the first transducer.

10. The system of claim 9, wherein the sensitivity of the second transducer is defined by the equation $$(M_{o,m2})^2 = \frac{Vm1, S}{Vm2, S} * \frac{1}{Zac} * \frac{Vm1, m2}{Iin}$$

where:

$M_{o,m2}$ = sensitivity of second transducer $V_{m1,S}$ = voltage generated in first *tansducer* by acoustic pressure waves from acoustic source $V_{m2,S}$ = voltage generated in second transducer by acoustic pressure waves from acoustic source -continued $$Z_{ac} = \frac{rc^2}{jv2_p f}$$

$r$ = gas density $c$ = sound speed $j$ = imaginary operator $sqrt(-1)$ $2_p f$ = radian frequency of sound $V$ = volume of acoustic chamber $V_{m1,m2}$ = voltage generated in first transducer by acoustic pressure waves from second membrane $I_{in}$ = current applied to second transducer.

11. The system of claim 10, where the value of $Z_{ac}$ is approximately equal to ±1.

12. A method for calibrating a microphone, comprising:

generating an acoustic pressure in an acoustic chamber of the microphone formed by an acoustic pressure assembly positioned over an acoustic port of the microphone;

measuring, by a controller, a voltage output by a first transducer of the microphone;

measuring, by a controller, a first voltage output by a second transducer of the microphone;

removing the acoustic pressure assembly, covering the acoustic port;

applying a current to the first transducer;

measuring, by a controller, a second voltage output by the second transducer; and calculating a sensitivity of the first and second transducers based on the measurements.

13. The method of claim 12, further comprising generating the acoustic pressure source in the acoustic chamber, the acoustic chamber formed by a housing of the microphone.

14. The method of claim 12, wherein applying the current to the first transducer causes the first transducer to generate a pressure wave.

15. The method of claim 12, wherein the sensitivity of the first and second transducer is output to at least one of a memory and an input/output interface.

16. The method of claim 12, wherein the sensitivity of the first transducer is calculated using the equation $$(M_{o,m1})^2 = \frac{Vm1, S}{Vm2, S} * \frac{1}{Zac} * \frac{Vm2, m1}{Iin}$$

where:

$M_{o,m1}$ = sensitivity of first transducer $V_{m1,S}$ = voltage generated in first transducer by acoustic pressure waves from acoustic source $V_{m2,S}$ = voltage generated in second transducer by acoustic pressure waves from acoustic source $$Z_{ac} = \frac{rc^2}{jv2_p f}$$

$r$ = gas density $c$ = sound speed $j$ = imaginary operator $sqrt(-1)$

-continued $2_p f$ = radian frequency of sound $V$ = volume of acoustic chamber $V_{m2,m1}$ = voltage generated in second transducer by acoustic pressure waves from first membrane $I_{in}$ = current applied to first transducer.

17. The method of claim 12, wherein the sensitivity of the second transducer is calculated using the equation $$(M_{o,m2})^2 = \frac{Vm1,S}{Vm2,S} * \frac{1}{Zac} * \frac{Vm1,m2}{Iin}$$

where:

$M_{o,m2}$ = sensitivity of second transducer $V_{m1,S}$ = voltage generated in first transducer by acoustic pressure waves from acoustic source $V_{m2,S}$ = voltage generated in second transducer by acoustic pressure waves from acoustic source -continued $$Z_{ac} = \frac{rc^2}{jv2_p f}$$

$r$ = gas density $c$ = sound speed $j$ = imaginary operator $sqrt(-1)$ $2_p f$ = radian frequency of sound $V$ = volume of acoustic chamber $V_{m1,m2}$ = voltage generated in first transducer by acoustic pressure waves from second membrane $I_{in}$ = current applied to second transducer.

18. The method of claim 16, wherein the sensitivity of the first transducer is calculated with $Z_{ac}=\pm 1$.

19. The method of claim 17, wherein the sensitivity of the second transducer is calculated with $Z_{ac}=\pm 1$.

* * * * *